United States Patent [19]

Matsunawa et al.

[11] Patent Number: 4,915,980

[45] Date of Patent: Apr. 10, 1990

[54] METHOD FOR PRODUCING AMORPHOUS METAL LAYER

[75] Inventors: Akira Matsunawa, Nishinomiya; Seiji Katayama, Saita; Takanori Kuroki, Munakata, all of Japan

[73] Assignee: Kuroki Kogyosho Co., Ltd., Fukuoka, Japan

[21] Appl. No.: 379,670

[22] Filed: Jul. 12, 1989

Related U.S. Application Data

[63] Continuation of Ser. No. 102,191, Sep. 29, 1987, abandoned.

[30] Foreign Application Priority Data

Sep. 30, 1986 [JP] Japan ..... 61-233763
Dec. 17, 1986 [JP] Japan ..... 61-302659

[51] Int. Cl.[4] ..... B05D 3/06; C22C 00/00
[52] U.S. Cl. ..... 427/53.1; 148/403; 148/DIG. 90
[58] Field of Search ..... 427/53.1; 228/800; 148/DIG. 70, 403; 75/10.13

[56] References Cited

U.S. PATENT DOCUMENTS

| | | | |
|---|---|---|---|
| 4,122,240 | 10/1978 | Banas et al. | 427/35 |
| 4,157,923 | 6/1979 | Yen et al. | 427/53.1 |
| 4,345,229 | 8/1982 | Alley et al. | 336/83 |
| 4,348,263 | 9/1982 | Draper et al. | 427/250 |
| 4,401,726 | 8/1983 | Gnanamuthu | 427/53.1 |
| 4,471,831 | 9/1984 | Ray | 164/508 |
| 4,512,824 | 4/1985 | Taub | 148/121 |
| 4,525,223 | 6/1985 | Tsuya et al. | 437/118 |
| 4,685,980 | 8/1987 | Sato et al. | 428/611 |
| 4,755,237 | 7/1988 | Lemelson | 148/403 |
| 4,769,094 | 9/1988 | Park et al. | 148/403 |
| 4,772,773 | 9/1988 | Hashimoto et al. | 219/121.66 |
| 4,834,806 | 5/1989 | Hashimoto et al. | 148/403 |

*Primary Examiner*—Norman Morgenstern
*Assistant Examiner*—Marianne L. Padgett

[57] ABSTRACT

A method metallurgically bonds a thin film of easily amorphized material on a metallic substrate having a large thermal conductivity, and then irradiates all or selected portions of the thin film with a pulse laser. The irradiated portions become amorphous by rapidly heating and cooling. Therefore, a whole surface which is an amorphous layer or a part of a surface which is an amorphous layer is obtained. In the latter, a porous amorphous metal layer is obtained by subsequent acid elution and by removing the non-amorphous part.

6 Claims, 4 Drawing Sheets

(a)

(b)

(C)

METHOD FOR PRODUCING AMORPHOUS METAL LAYER

This application is a continuation of application Ser. No. 102,191, filed Sept. 29, 1987 now abandoned.

BACKGROUND OF THE INVENTION

The present invention relates to a method for producing an amorphous metal layer and an amorphous alloy layer having small sized pores. The use of amorphous metal layers, which possess excellent mechanical, physical and chemical properties such as corrosion resistance, strong toughness, optical properties and magnetic properties, is rapidly expanding. An amorphous metal is non-crystalline, and is obtained by methods such as the metal gas condensation method, the rapid cooling method of liquid metal, or the fault introducing method for crystals for the purpose of producing an amorphous state. Of the methods, the method of rapidly quenching liquid metal is suited to continuously produce large amounts of materials and is generally used. Many papers report that in one rapid quenching method, an amorphous surface is rapidly heated and fused by giving laser irradiation to a metal material having a high amorphous-formation ability, and the surface layer part becomes amorphous. However, there are problems such as that the amorphous state or layer becomes crystallized again. The heterogeneity of the composition and the shape of the amorphous layer is observed at the part of overlapped laser irradiation. Cracks are further observed. In order to take advantage of amorphous metals, materials having a uniform thickness amorphous metal are required for use as electrode material, contacts, wear-resistant material or magnetic material. Also, there are many cases requiring that an amorphous metal having the abovementioned many advantages be formed as a wire net or a porous sheet, or such formed objects are joined and rested on a base plate depending on the use. Also, when making a form where the amorphous layer itself has fine pores, uses as a filter for corrosive material or a printing negative increase. Therefore, in the existing state of the art, an amorphous metal is difficult to work to the form of a wire net or a porous sheet because amorphous metal itself is tough.

SUMMARY OF THE INVENTION

It is an object of the present invention to provide a method in which an amorphous metal not having cracks and having a uniform thickness is easily produced on a base material surface. It is also another object of the present invention to provide a method in which the object alloy layers are made amorphous and are simultaneously formed as a wire net or a porous sheet.

DETAILED DESCRIPTION OF THE INVENTION

The following embodiments are a detailed description of the present invention.

EMBODIMENT 1

Experiments using a Cu substrate and a Ni substrate constitute Embodiment 1.

Figure 1:
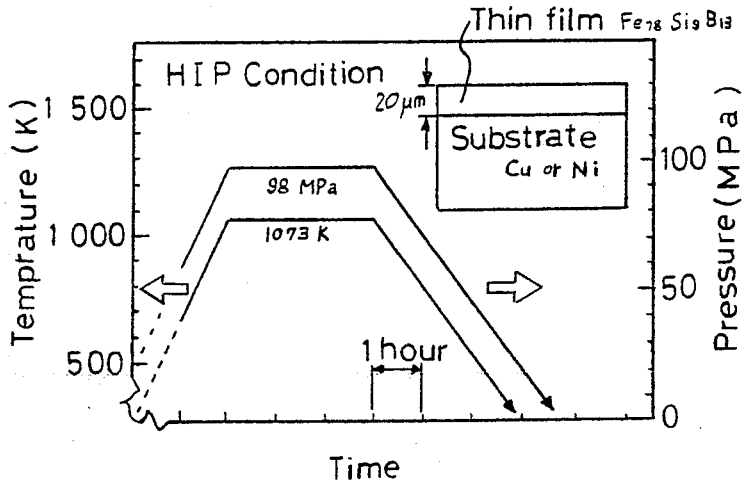
FIG. 1 is a schematic view of an HIP condition and a specimen section for Embodiment 1.

$Fe_{78}Si_9B_{13}$ for magnetic materials was bonded as a 25 mm wide and about a 40 $\mu$m thick thin film on 50 mm$\times$50 mm and 10 mm thickness Cu and Ni substrates by hot isostatic pressure (hereinafter HIP), and then, the thickness of the thin film was finished to 20 $\mu$m. The HIP condition and a schematic view of a specimen section in this case are shown in FIG. 1.

For such specimens, concerning the relationship of the fused part shaped by laser irradiation and the condition of laser irradiation, the defocused distance(fd) and laser energy(Eo) were changed, the condition of obtaining a plain surface was required, pulse laser irradiation was applied under such condition, and the forming condition of the amorphous surface layer was examined. Also, pulse laser was applied under an Ar gas atmosphere, the structure of the surface and a section of a laser irradiation molten part was observed by optical microscope and scanning electron microscope, and the condition of the amorphous layer formation was further examined by X-ray diffractometer.

Figure 2:
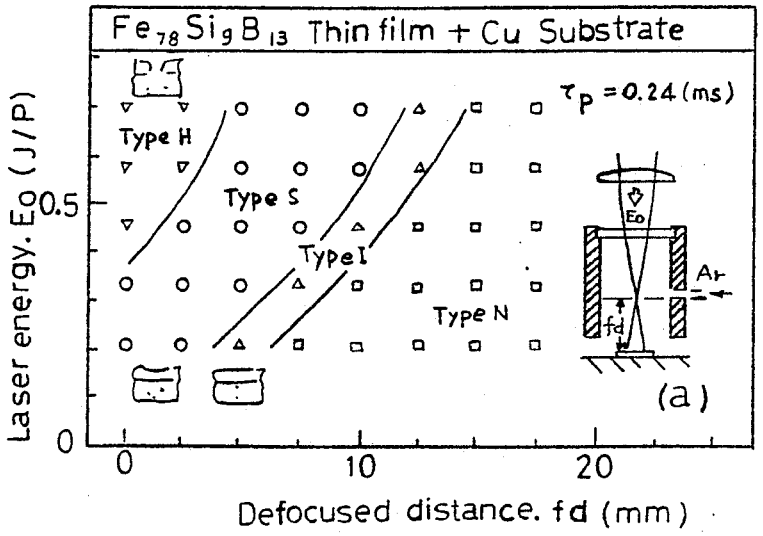
FIG. 2 is a graph showing the relationship of the condition of laser irradiation and the obtained surface using a Cu substrate.
Figure 3:
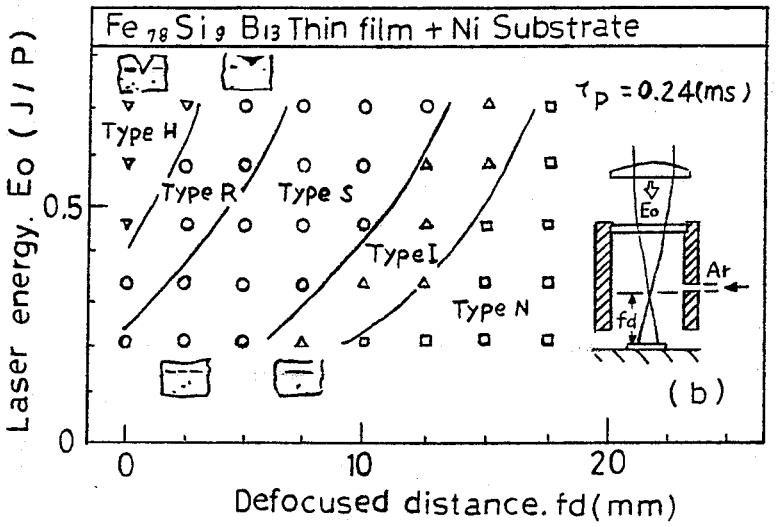
FIG. 3 is a graph showing the relationship of the condition of laser irradiation and the obtained surface using a Ni substrate.

As for results, the surface condition of various kinds of molten parts was observed and the surface conditions were classified into five groups: formations having pores(Type H), formations having unevenness of surface(Type R), formations having a smooth surface(Type S), formations having a non-uniform molten surface(Type I) and formations having an insoluble surface(Type N). FIG. 2(Cu substrate) and FIG. 3(Ni substrate) show schematically the relationship of the above-mentioned five types and the laser irradiation condition.

An amorphous layer not having cracks was classified as Type S. From the results of FIG. 2 and FIG. 3, when a Cu substrate was used in an area having a high energy density, the substrate did not fuse and only the surface of the amorphous metal thin film had pores. When using a Ni substrate, the substrate fused at the same time, and cracks were observed in the central part.

The reason for the above-mentioned result is that $Fe_{78}Si_9B_{13}$ was used as an easily amorphized material thin film. If the materials having a low thermal conductivity are used for the easily amorphized material, a sufficiently uniform amorphous metal without cracks is obtained even using a Ni substrate. Furthermore, in the Cu substrate shown in FIG. 2, if fd is not changed, and Eo is lowered in an area of Type H, or Eo is not changed and fd is lowered, then Type H is easily moved into an area of Type S. However, in the Ni substrate shown in FIG. 3, cracks are caused in Type H, and an area of Type R containing non-amorphous layer parts exists between Type H and Type S by dilution of the substrate. Therefore, it is hard to move directly from Type H to Type S, and it is also found that the condition set points become complex.

Next, for the condition that a smooth plain surface such as the above-mentioned is obtained, the surface of the specimen in which the $Fe_{78}Si_9B_{13}$ thin film layer is bonded on the Cu substrate of the embodiment of the present invention was given repetitive overlapped irradiation with laser, the whole area of the surface was fused and solidified, and the surface condition of the melt-in condition was examined. When the above-mentioned results wee observed by surface microstructure and section-scanning electron microscope, it was found that a smooth surface condition and uniform melt-in depth are obtained in the case of overlapped irradiation with a laser.

Next, concerning the specimen after the above-mentioned overlapped laser irradiation treatment, the formation of the amorphous alloy layer was examined.

Figure 4:
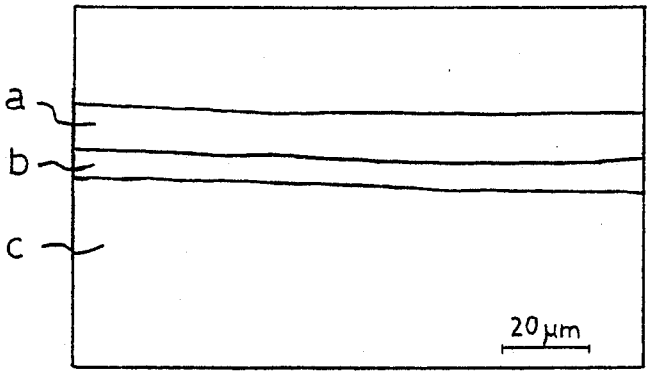
FIG. 4 is a schematic view showing the section condition of a laser irradiated part.

Examination revealed that there are laser irradiated molten part (1), non-molten part (2) and substrate (3). As shown in FIG. 4, the laser irradiation molten part has a low degree of etching compared with the non-molten part in microscopic observation, and the amorphous phase is almost a single layer.

Figure 5:
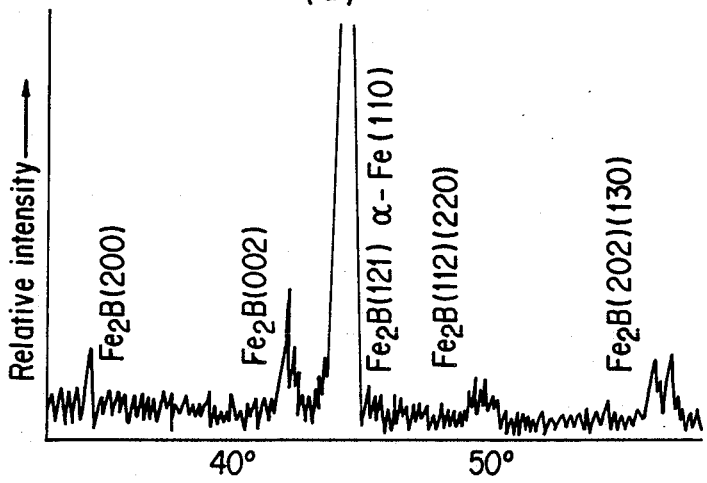
FIGS. 5(*a*), (*b*) and (*c*) are X-ray diffractometer graphs, respectively, of the condition before laser irradiation and after laser irradiation using a Cu substrate and the condition after laser irradiation using a Ni substrate.
Figure 5:
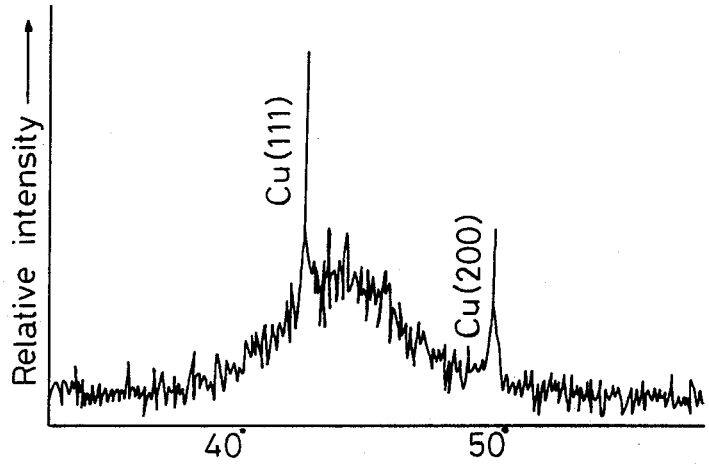
Figure 5:
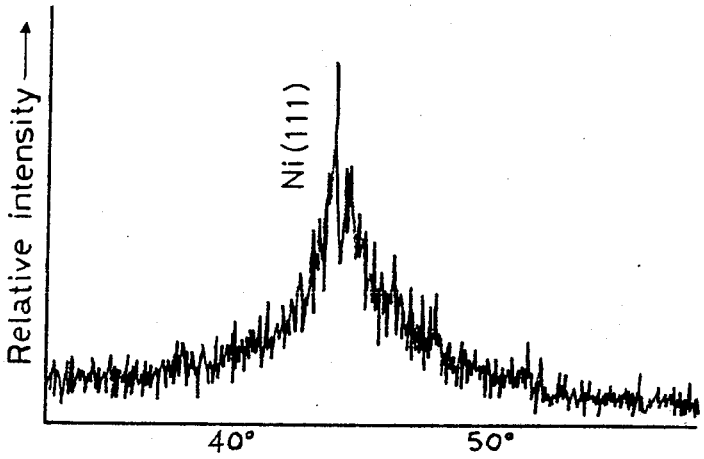

The results of the above-mentioned observation by X-ray diffractometer are shown in FIGS. 5(*a*), (*b*) and (*c*). FIG. 5(*a*) shows X-ray diffraction when $Fe_{78}Si_9B_{13}$ is bonded on a Cu substrate before laser irradiation. FIGS. 5(*b*) and (*c*) show X-ray diffraction when specimens of $Fe_{78}Si_9B_{13}$ bonded on a Cu substrate and a Ni substrate in the present embodiment are treated by laser. In FIG. 5(*a*), the specimen is heated to 1073K by HIP treament, and the compounds of Fe and $Fe_2B$ metals are produced as a thin film and are crystallized. However, in FIGS. 5(*b*) and (*c*), a broad X-ray diffracted peak which is the characteristic of an amorphous condition is confirmed. And partly, a non-molten part at a lower part and a peak showing a crystal structure of Cu and Ni are observed.

From the above-mentioned results, in laser treatment condition where a plain surface is obtained without fusing the substrate, it is found that a non-molten part of the thin film stays as a crystal structure, but a molten part attains the amorphous condition.

As mentioned above, from the examinations and results in Embodiment 1, it is possible to form an amorphous layer having uniform depth. However, as found by comparing FIG. 2 and FIG. 3, a Cu substrate obtains a good surface condition much more than a Ni substrate and is easily controlled to that condition. This is because Cu has good thermal conductivity, and the surface of Cu easily reflects laser irradiation, even if the Cu surface is exposed during irradiating and is hardly fused. These properties are the same with Ag or copper-silver alloys.

Additionally, as for amorphous alloys, an examination in which the alloys shown in the following Table 1 are laser-irradiated at the block condition was conducted similarly to the abovementioned $Fe_{78}Si_9B_{13}$.

Table 1 shows the structure and cracks-evolving situation. In the items of the structures in Table 1, A indicates an amorphous structure, C indicates a crystal structure, (A) indicates a partly amorphous structure, and (C) indicates a partly crystal structure.

From the results of Table 1, even given an easily amorphized material, it is found that a uniform amorphous layer is hardly obtained, and a lot of cracks are evolved using laser irradiation at the block state excepting a small number of alloys.

TABLE 1

| No. | Material (at %) | Structure | cracks |
|---|---|---|---|
| 1 | $Pd_{40}Ni_{40}P_{20}$ | A | none |
| 2 | $Pb_{78}Cu_6Si_{16}$ | A | none |
| 3 | $Ni_{53}Pb_{27}P_{20}$ | A | none |
| 4 | $Ni_{63}Nd_{37}$ | A + (C) | exist |
| 5 | $Ni_{60}Nd_{40}$ | A + (C) | exist |
| 6 | $Pd_{82}Si_{18}$ | A + (C) | partly exist |
| 7 | $Cu_{56}Zr_{44}$ | A + C | partly exist |
| 8 | $Ni_{64}Zr_{36}$ | A + C | exist |
| 9 | $Fe_{41.5}Ni_{41.5}B_{17}$ | C | exist |
| 10 | $Au_{78}Ge_{14}Si_8$ | C | exist |
| 11 | $Ni_{80}P_{20}$ | C + (A) | exist |
| 12 | $Pd_{40}Ni_{40}P_{10}Si_{10}$ | A | none |
| 13 | $Fe_{78}Si_9B_{13}$ | A + (C) | exist |
| 14 | $Fe_{73}Si_{12}B_5$ | A + (C) | exist |
| 15 | $Fe_{79}Si_{14}B_{14}$ | A + (C) | exist |
| 16 | $Fe_{83}P_{10}C_7$ | C | exist |
| 17 | $Fe_{40}Ni_{40}P_{14}B_6$ | C | exist |
| 18 | $Ti_{70}Ni_{30}$ | C | exist |

Additionally, in the present invention, the substrate and easily amorphized material at an upper face of the substrate have to be metallurgically bonded before laser irradiation. This is because the amorphous condition is not sufficiently achieved due to bad thermal conductivity. For metallurgical bonding, there can be used coating, press-bonding and other kinds of methods including HIP bonding as employed in the above-mentioned embodiment.

Also, for an easy amorphization material, it is possible to use an alloy which is once changed to the amorphous condition by a different manner or to use an alloy of a fusion-produced crystal structure as shown in the embodiment.

EMBODIMENT 2

In Embodiment 2, an $Fe_{78}Si_9B_{13}$ thin film layer was bonded on a Cu substrate and Ni substrate which are the same as in Embodiment 1 under the condition of a smooth Type S structure as shown in the above-mentioned Embodiment 1. The bonded specimen was laser-irradiated and was fused and solidified under the condition that a lot of non-laser irradiated parts exist, and the surface condition and the melt-in condition or depth of melting, under laser irradiation were examined. The results were observed by using a photomicrostructure and scanning electron microscope at the section of the specimen. A nearly round-shape white color and a non-amorphous part having a nearly round-shape black color were observed. The laser-irradiated parts were only changed to an amorphous condition, and a nice surface condition and uniform melt-in depth were observed in these parts.

Next, concerning the specimen after the above-mentioned laser-irradiated treatment, the formation of an amorphous alloy layer was examined.

Similar to the results shown in FIG. 4 in the above-mentioned Embodimennt 1, a laser-irradiated fused part, non-fused part and substrate were formed from the surface in order, but it was also found that the laser-irradiated fused part had a low degree of etching compared with the non-fused part and was nearly a single layer. Also, in the specimen in Embodiment 2, the product was confirmed by X-ray diffractometer, and a result the same as the result shown in FIG. 5 was observed.

Additionally, in Type H shown in the above-mentioned Embodiment 1, in the case of using Cu as the substrate, nearly uniform pores were observed over the whole depth of the thin film, and pores were not observed in the Cu substrate. This is because Cu has good thermal conductivity compared with Ni, and rapidly attains an edothermic condition, and Cu itself reflects laser light. It is considered that the size of pores on the thin film becomes almost the same at an upper part and a lower part by the reflective strength at the time of reflection, i.e., at the time when the laser is reflected by the copper plate.

Concerning the results of Embodiments 1 and 2 synthetically, it is found that an easily amorphized material bonded on such a substrate as Cu having a large degree of thermal conductivity results in an amorphous metal having many pores obtained by being partially fused by laser irradiation and being defective because of spatter (a) or an amorphous metal having non-pores(b) and uniform thickness by irradiating with a controlled pulse laser.

Accordingly, by pulse laser irradiating under the condition such as (b), it is easy to form an amorphous metal having uniform thickness on the surface of a metallic material having a large degree of thermal conductivity such as copper, silver, or their alloys. Such an amorphous metal is metallurgically bonded with the substrate in advance. Therefore, it is suitable for many uses by working the amorphous metal to the necessary shape.

Also, the parts where the laser does not reach remain as the condition for an amorphous metal having many pores such as (a). By laser irradiating such that an amorphous metal having uniform thickness such as (b) is obtained, there are many parts where the laser does not reach. As a result, in both methods, an amorphous metal layer in which non-amorphous metal parts exist a lot is obtained. Next, only the non-amorphous part which is unnecessary, depending on the use, or both the non-amorphous part and substrate are eluted and dissipated using an acid. The kind of acid in this case is chosen by considering acid elution of amorphous metal versus non-amorphous metal or substrate. However, amorphous metal has remarkably excellent corrosion resistance, so that it is difficult to select the kind of acid.

By using the above-mentioned method, it is possible to obtain a porous metal layer having various shapes which are decided upon depending on the laser irradiation at an early step. Laser irradiation is possible for microcontrol. Therefore, it is also possible to produce a filter-like metal plate having a lot of fine pores.

Also, in the method of the present invention, it is possible to wholly produce an amorphous layer on the surface of a solid-shaped object, to form an amorphous layer having many pores, or to produce a solid-shaped amorphous metal body regardless of non-pores or pores. It is already possible to use laser irradiation for a three-dimensional effect and to produce many shapes which were hitherto difficult.

What is claimed is:

1. A method for producing an amorphous metal layer on a substrate, comprising (a) metallurgically bonding a material to a substrate to form a thin film of said material on said substrate, said substrate comprising a metal having a greater thermal conductivity than a thermal conductivity of said material, at least a portion of said material film being non-amorphous but easily-convertible to an amorphous state;

(b) irradiating a plurality of separate areas of said non-amorphous portion of said film with a pulse-laser to fuse said film and substrate while rapidly solidifying said film to convert said irradiated areas to a plurality of amorphous areas separated by a plurality of non-irradiated, non-amorphous areas; and (c) eluting and dissipating said plurality of non-irradiated, non-amorphous areas.

2. A method for producing an amorphous metal layer on a substrate as in claim 1, wherein said substrate is selected from the group consisting of copper, silver and copper-silver alloys.

3. A method for producing an amorphous metal layer on a substrate as in claim 1, wherein said material is $Fe_{78}Si_9B_{13}$.

4. A method for producing an amorphous metal layer on a substrate as in claim 1, wherein said material is metallurgically bonded to said substrate by hot isostatic pressure.

5. A method for producing an amorphous metal layer on a substrate as in claim 1, wherein said material is selected from the group consisting of $Pd_{40}Ni_{40}P_{20}$, $Pb_{78}Cu_6Si_{16}$, $Ni_{53}Pb_{27}P_{20}$, and $Pd_{40}Ni_{40}P_{10}Si_{10}$.

6. A method for producing an amorphous metal layer on a substrate as in claim 1, wherein said substrate is selected from the group consisting of copper, silver and copper-silver alloys, said material is selected from the group consisting of $Pd_{40}Ni_{40}P_{20}$, $Pb_{78}Cu_6Si_{16}$, $Ni_{53}Pb_{27}P_{20}$, $Pd_{40}Ni_{40}P_{10}Si_{10}$, and $Fe_{78}Si_9B_{13}$, and wherein said material is metallurgically bonded to said substrate by hot isostatic pressure.

* * * * *